United States Patent [19]

Gecht et al.

[11] Patent Number: 4,583,730

[45] Date of Patent: Apr. 22, 1986

[54] MARTIAL ARTS PRACTICE DEVICE WITH BREAKAGE

[76] Inventors: Brent A. Gecht, 8626 W. Fiebrantz Ave., Milwaukee, Wis. 53222; Thomas M. Riley, 12567 Woodberry Dr., Mequon, Wis. 53092

[21] Appl. No.: 705,979

[22] Filed: Feb. 27, 1985

[51] Int. Cl.[4] ..... A63B 69/00

[52] U.S. Cl. ..... 272/76

[58] Field of Search ..... 272/76–78, 272/93, DIG. 10; 273/382

[56] References Cited

U.S. PATENT DOCUMENTS

| | | | |
|---|---|---|---|
| 2,432,596 | 12/1947 | Tindale | 273/382 |
| 2,509,666 | 5/1950 | Armstrong | 273/382 |
| 3,883,135 | 5/1975 | Milliken | 272/76 X |
| 3,973,772 | 8/1976 | Milliken | 272/76 |
| 4,004,799 | 1/1977 | Kundert | 272/76 X |
| 4,052,056 | 10/1977 | Friedenthal | 272/76 |
| 4,171,803 | 10/1979 | Smith | 272/76 |
| 4,387,892 | 6/1983 | Wen | 272/76 |

FOREIGN PATENT DOCUMENTS

| | | | |
|---|---|---|---|
| 1420471 | of 1965 | France | 272/76 |
| 1526964 | 4/1968 | France | 272/76 |

*Primary Examiner*—Richard J. Apley
*Assistant Examiner*—Kathleen D'Arrigo
*Attorney, Agent, or Firm*—Andrus, Sceales, Starke & Sawall

[57] ABSTRACT

A martial arts practice device (2) is provided for programmably simulating the breaking of a variably selective number of boards with actual breakage of smaller less costly slats (4, 76), but requiring comparable impact. A pair of hinged arms (16) and (18) mounted on a frame (6) have one or more slats (4, 76) mounted adjacently therebelow which are broken by the practitioner's impact on the top of the hinged arms (16 and 18). After breakage, the arms are pivoted back to a horizontal position and new slats are loaded for the next sequence.

13 Claims, 4 Drawing Figures

MARTIAL ARTS PRACTICE DEVICE WITH BREAKAGE

BACKGROUND AND SUMMARY

The present invention relates to a martial arts practice device simulating real conditions at significantly reduced cost.

The present invention provides a martial arts practice device for simulating the breaking of boards and the like with an actual break of smaller less costly slats but requiring comparable impact. The cost savings is significant, typically a factor of 10, and enables the practitioner to engage in a full workout.

The practice device in accordance with the invention features re-usable impact breakaway means providing actual breakage of throw-away slats. After impact and breakage, the device is reloaded with new slats for the next sequence.

The invention features programmable simulation of the breaking of a variably selective number of boards and materials without modifying or otherwise altering the structure of the device. A given number of slats corresponds with a given number of boards desired to be simulated. The breakage simulates actual penetration.

The practice device of the invention is further characterized by its versatility and portability. The device may be mounted on a horizontal or vertical surface for hand or foot or other types of impact. The device may also be held by one or more assistants.

The invention enables a fully adjustable programmed resistance device that allows the practioner to achieve maximum effectiveness in breaking techniques, by simulating the resistance of various materials such as wood, bricks, tiles, concrete blocks, etc., and hence is a significant advance in training aids. By simple substitution of different slat materials and/or more or less slats, the device can simulate breakage of different constituent materials as well as single or multiple breaks. The device facilitates quick and easy reloading in preparation for the next sequence.

A martial arts nonbreakage practice device is shown in co-pending Application Ser. No. 706,033.

DETAILED DESCRIPTION

Figure 1:
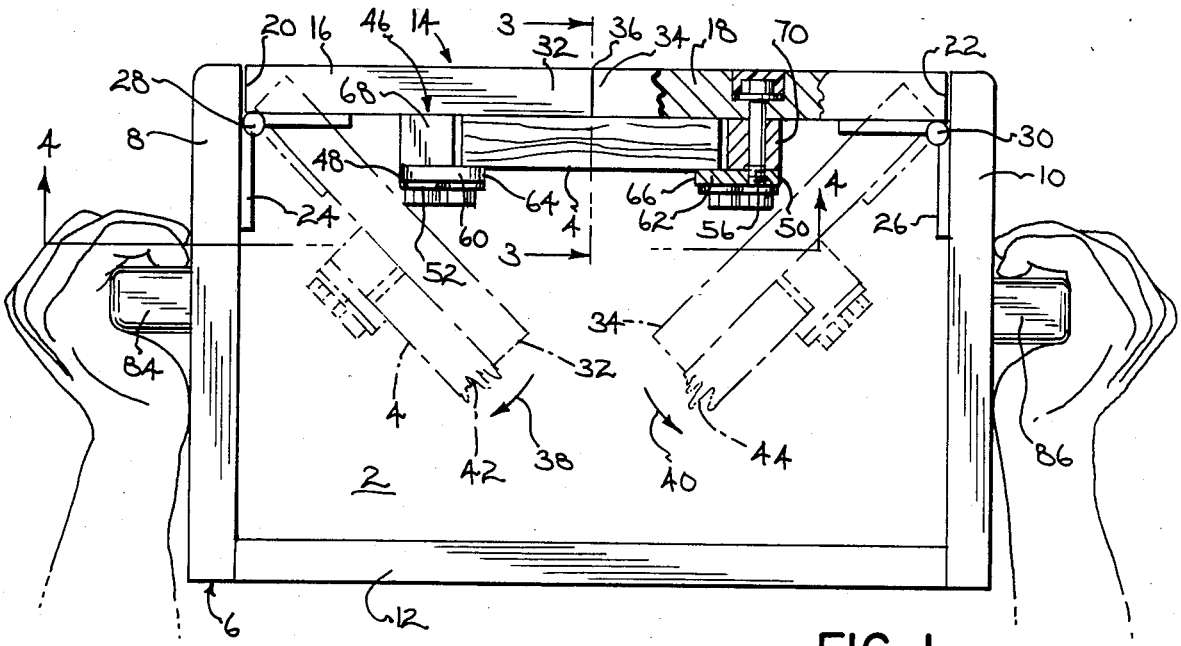
FIG. 1 is a front elevation view of a martial arts practice device in accordance with the invention.
Figure 3:
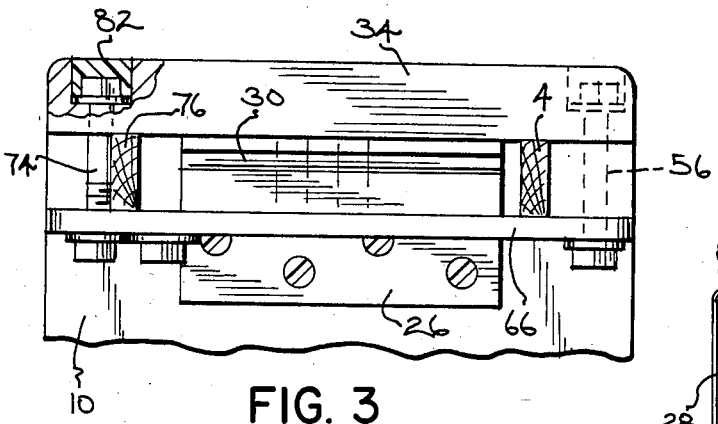
FIG. 3 is a sectional view taken along line 3—3 of FIG. 1.

FIG. 1 shows a martial arts practice device 2 for simulating the breaking of boards and the like with an actual break of smaller less costly slats 4 but requiring comparable impact. A frame 6 is provided by left and right sidewalls 8 and 10 mounted at their lower ends to a bottom wall 12. Hinged arm means 14 is supported on the frame and movable between first and second positions as shown respectively in solid and dashed line in FIG. 1. Hinged arm means 14 is provided by a pair of hinged arms 16 and 18 having distally opposite outer ends 20 and 22 mounted to the frame at the upper ends of left and right sidewalls 8 and 10 by hinges 24 and 26 providing pivot points 28 and 30 whose pivot axes extend horizontally front-back. Hinged arms 16 and 18 have inner ends 32 and 34 facing each other at interface 36 in the noted first position, solid line, defining a substantially flat horizontal plane simulating a normal size board to be broken. Hinged arms 16 and 18 are pivoted downwardly to the second position, dashed line, with the inner ends 32 and 34 moving downwardly and away from each other as shown at arrows 38 and 40. As seen, the hinged arm means is mounted to the frame at a pivot point and has an opposite end swingable in an arc as at 38, 40 about the pivot point between the first and second positions. Slat 4 has a middle section broken as at 42, 44 by the end of the hinged arm means.

Mounting means 46 mounts slat 4 along the underside of arms 16 and 18 in the noted horizontal first position such that impact by the martial arts practitioner against the top of the arms with a vertically downward blow breaks slat 4 beneath the arms and drives the arms to the second position shown in dashed line. Mounting means 46 includes first and second retainers 48 and 50 secured by respective bolts 52, 54, and 56, 58, FIGS. 1 and 4, to the undersides of respective first and second arms 16 and 18. At the bottom of the bolts above respective nuts are horizontally front-back extending plates 60 and 62 through which the bolts extend. Left plate 60 has an inner right end 64 extending beneath slat 4, and right plate 62 has an inner left end 66 extending beneath slat 4. The bolts also extend through respective spacers 68 and 70 which have a vertical height substantially the same as or slightly greater than that of slat 4.

Figure 2:
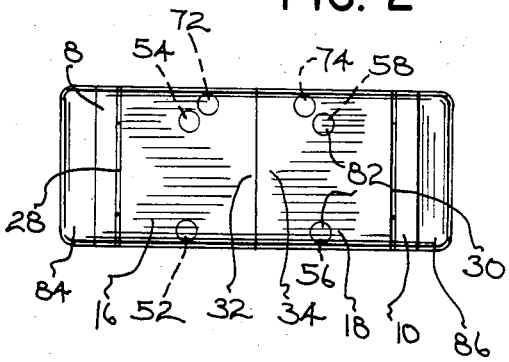
FIG. 2 is a top elevation view of the device in FIG. 1.
Figure 4:
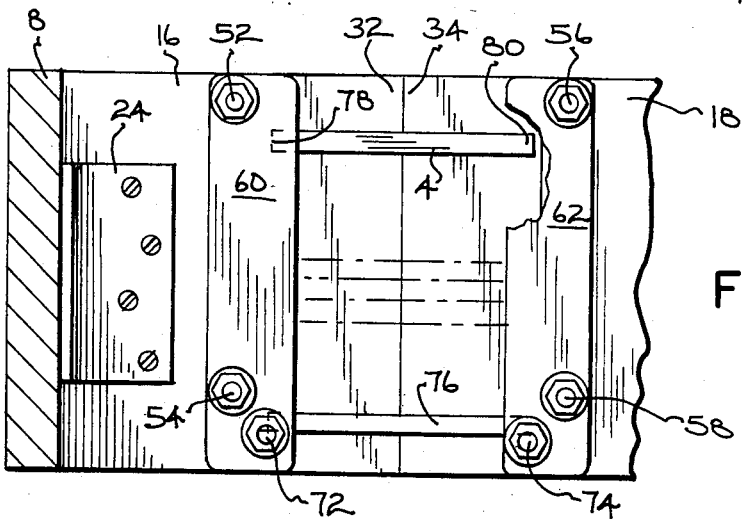
FIG. 4 is a sectional view taken along line 4—4 of FIG. 1.

At the rear, an additional pair of bolts 72 and 74, FIG. 4, extend downwardly through hinged arms 16 and 18 and through respective plates 60 and 62 and are offset slightly inwardly from bolts 52, 54, and 56, 58 to provide end stops limiting rearward insertion of the slats as shown at slat 76, FIG. 4, being stopped against bolts 72 and 74 when inserted horizontally front to back as viewed in FIG. 1. The disclosed plate and retaining structure thus provides a pair of horizontal guide channels for the slats. The slats are fixedly mounted at their distal ends, as shown at 78 and 80 for slat 4, in the first and second retainer means 48 and 50. The top heads of the bolts are recessed in the top surfaces of hinged arms 16 and 18, and the counter sunk holes or the like in such top surfaces of the hinged arms are plugged with epoxy or the like as shown at 82 in FIG. 2 and sanded or otherwise finished to provide a flush surface for impact by the practitioner and to protect the practitioner from jagged edges and the like.

A plurality of slats such as 4 and 76 may be stacked in the first and second retainers 48 and 50 to simulate breakage of a number of boards. In the disclosed embodiment, the direction of stacking is horizontally front-back beneath the facing inner ends 32 and 34 of hinged arms 16 and 18 such that the slats break simultaneously in parallel, rather than in series as would occur if the slats were stacked vertically. Arms 16 and 18 provide re-usable impact breakaway means providing actual breakage of throw-away slats. The breakaway means is returnable to the first position after breakage of the slats, for reloading of another slat or slats and repetition of the breakage. Device 2 programmably simulates the breaking of a variably selective number of boards. The number of slats determines the number of boards desired to be simulated and are selectively changeable. The same device 2 accommodates the changing board number simulation without structural modification of device 2.

Frame 6 is preferably made of a hard durable material, such as oak. Sidewalls 8 and 10 have a vertical height sufficient to enable the martial arts practitioner to achieve full extension and follow-through after breakage of the slats without being stopped by the bottom wall 12. Cushioning pads may be provided on the upper surfaces of arms 16 and 18 and/or bottom wall 12. Handles 84 and 86 are provided on the outsides of left and right sidewalls 8 and 10 and enable the frame to be held vertically by an assistant for foot impact by the practitioner.

It is recognized that various alternatives and modifications are possible within the scope of the appended claims.

We claim:

1. A martial arts practice device for simulating the breaking of boards and the like with actual breakage of smaller less costly slats but requiring comparable impact, comprising:

a frame;

hinged arm means supported on said frame and movable between first and second positions;

means for mounting at least one said slat adjacent said hinged arm means in said first position such that impact of the martial arts practitioner against said hinged arm means breaks said slat and moves said hinged arm means to said second position.

2. The invention according to claim 1 wherein:

said hinged arm means is mounted to said frame at a pivot point and has an opposite end swingable in an arc about said pivot point between said first and second positions;

said slat has a middle section broken by said end of said hinged arm means and has an end mounted by said mounting means to a middle section of said hinged arm means between said pivot point and said end of said hinged arm means.

3. The invention according to claim 1 wherein:

said hinged arm means comprises a pair of hinged arms having distally opposite outer ends mounted to said frame at respective distally opposed pivot points and having inner ends facing each other in said first position to define a substantially flat plane simulating one of said first mentioned boards, said arms being pivoted downwardly to said second position with said inner ends moving downwardly and away from each other;

said mounting means mounts said slat along the underside of said arms in said first position such that impact by the martial arts practitioner against the top of said arms breaks said slat below said arms and drives said arms to said second position.

4. The invention according to claim 3 wherein said mounting means comprises first and second retainer means secured respectively to the undersides of said first and second arms, and said slat is fixedly mounted at its distal ends in said first and second retainer means.

5. The invention according to claim 4 comprising a plurality of said slats stacked in said first and second retainers to simulate breakage of a number of said boards.

6. The invention according to claim 5 wherein the direction of stacking of said slats extends horizontally front-back beneath said facing inner ends of said hinged arms such that said slats break simultaneously in parallel, rather than in series.

7. The invention according to claim 4 wherein said frame comprises a pair of left and right sidewalls mounted at their lower ends to a bottom wall, said hinged arms being pivoted at the upper ends of said left and right sidewalls, and wherein said left and right sidewalls have a height sufficient to enable the martial arts practitioner to achieve full extension and follow-through after breakage without being stopped by said bottom wall.

8. The invention according to claim 7 comprising handle means on the outsides of said left and right sidewalls enabling said frame to be held vertically by an assistant for foot impact by the practitioner.

9. A martial arts practice device with reusable impact breakaway means providing actual breakage of throw-away slats comprising:

a frame;

re-usable impact breakaway means supported on said frame and movable between first and second positions;

means for mounting a throw-away slat in a given position when said breakaway means is in said first position such that said slat breaks when said breakaway means is moved to said second position by impact of the martial arts practitioner.

10. The invention according to claim 9 wherein said breakaway means is returnable to said first position after breakage of said slat, for reloading of another said slat and repetition of said breakage.

11. The invention according to claim 10 wherein said breakaway means comprises a pair of hinged arms having distally opposite outer ends mounted to said frame at respective distally opposed pivot points and having inner ends facing each other in said first position to define a substantially flat plane, said arms being pivoted downwardly to said second position with said inner ends moving downwardly and away from each other, and wherein said mounting means mounts said slat along the underside of said arms in said first position such that impact by the martial arts practitioner against the top of said arms breaks said slat beneath said arms and drives said arms to said second position.

12. A martial arts device for programmably simulating the breaking of a variably selective number of boards comprising:

a frame;

re-usable breakaway hinged arm means comprising a pair of hinged arms having distally opposite outer ends mounted to said frame at respective distally opposed pivot points and having inner ends facing each other in a first position to define a substantially flat plane simulating one of said first mentioned boards, said arms being pivoted downwardly to a second position with said inner ends moving downwardly and away from each other;

means for mounting a variably selective number of throw-away slats, which are smaller and less costly than said boards, along the underside of said arms in said first position such that impact by the martial arts practitioner against the top of said arms breaks said slats below said arms and drives said arms to said second position, the number of said slats determining the number of said boards desired to be simulated and being selectively changeable, the same said device accommodating said changing board number simulation.

13. The invention according to claim 12 wherein:

said impact is vertically downward;

the axes of pivoting of said arms extend horizontally front-back;

each said slat extends horizontally left-right;

said slats are stacked in a stacking direction extending horizontally front-back.

* * * * *